US010436393B2

(12) United States Patent
Wang et al.

(10) Patent No.: US 10,436,393 B2
(45) Date of Patent: Oct. 8, 2019

(54) LIGHTING DEVICE AND LUMINAIRE COMPRISING THE SAME

(71) Applicant: SIGNIFY HOLDING B.V., Eindhoven (NL)

(72) Inventors: Lin Wang, Eindhoven (NL); Guyuan Chen, Eindhoven (NL); Aibin Zou, Eindhoven (NL); Jingxu Zhou, Eindhoven (NL); Haoran Zhang, Eindhoven (NL); Xiuru Wang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/087,496

(22) PCT Filed: Apr. 20, 2017

(86) PCT No.: PCT/EP2017/059403
§ 371 (c)(1),
(2) Date: Sep. 21, 2018

(87) PCT Pub. No.: WO2017/182572
PCT Pub. Date: Oct. 26, 2017

(65) Prior Publication Data

US 2019/0101246 A1 Apr. 4, 2019

(30) Foreign Application Priority Data

Apr. 22, 2016 (WO) ..... PCT/CN2016/080009
May 17, 2016 (EP) ..... 16169838

(51) Int. Cl.
*F21K 9/233* (2016.01)
*F21V 5/04* (2006.01)
(Continued)

(52) U.S. Cl.
CPC ..... *F21K 9/233* (2016.08); *F21K 9/237* (2016.08); *F21K 9/60* (2016.08); *F21K 9/62* (2016.08);
(Continued)

(58) Field of Classification Search
CPC ... F21K 9/233; F21K 9/62; F21K 9/69; F21K 9/237; F21K 9/60; F21K 9/20;
(Continued)

(56) References Cited

U.S. PATENT DOCUMENTS 7,581,854 B2 * 9/2009 Ford ..... F21V 14/06 362/311.02
8,310,685 B2 11/2012 Dimitrov-Kuhl et al.
(Continued)

FOREIGN PATENT DOCUMENTS

CN 101691915 A 4/2010
JP 2010251009 A 11/2010
(Continued)

*Primary Examiner* — Mary Ellen Bowman
(74) *Attorney, Agent, or Firm* — Daniel J. Piotrowski

(57) ABSTRACT

Disclosed is a lighting device (200) comprising a mounting surface (201); a lens (100) comprising a lens body (101) having an inner surface (102) encapsulating a cavity (103) and delimiting an entrance to said cavity, said entrance facing the mounting surface, the inner surface comprising a plurality of adjoining surface sections each defining a segment of the cavity, wherein each segment has a narrowing region distal to the entrance delimited by a curved portion (106) of the surface section delimiting said segment; and an elongate carrier (202) extending from the mounting surface into the cavity segments through the cavity entrance and comprising a plurality of solid state lighting elements (203) configured to emit light towards the lens body. Further disclosed is a luminaire comprising the said lighting device.

14 Claims, 6 Drawing Sheets

(51) Int. Cl.

| | |
|---|---|
| ***F21V 19/00*** | (2006.01) |
| ***F21K 9/60*** | (2016.01) |
| ***F21K 9/62*** | (2016.01) |
| ***F21K 9/69*** | (2016.01) |
| ***F21K 9/237*** | (2016.01) |
| ***F21V 5/00*** | (2018.01) |
| ***F21K 9/20*** | (2016.01) |
| ***F21K 9/232*** | (2016.01) |
| ***F21Y 115/10*** | (2016.01) |
| ***F21Y 107/90*** | (2016.01) |

(52) U.S. Cl.
CPC ..... *F21K 9/69* (2016.08); *F21V 5/045* (2013.01); *F21V 19/003* (2013.01); *F21K 9/20* (2016.08); *F21K 9/232* (2016.08); *F21V 5/004* (2013.01); *F21Y 2107/90* (2016.08); *F21Y 2115/10* (2016.08)

(58) Field of Classification Search
CPC ..... F21K 9/232; F21V 5/045; F21V 5/004; F21V 19/003; F21Y 2107/90; F21Y 2115/10
See application file for complete search history.

(56) References Cited

U.S. PATENT DOCUMENTS

| | | | | |
|---|---|---|---|---|
| 9,175,832 | B2 | 11/2015 | Sy et al. | |
| 2006/0176702 | A1 | 8/2006 | Shen et al. | |
| 2009/0129097 | A1* | 5/2009 | Ewert | B29C 45/0025 362/328 |
| 2011/0141747 | A1 | 6/2011 | Biar | |
| 2013/0200410 | A1 | 8/2013 | Kim et al. | |
| 2013/0314927 | A1 | 11/2013 | Chae et al. | |
| 2014/0001507 | A1* | 1/2014 | Streppel | F21V 5/002 257/98 |
| 2014/0268802 | A1 | 9/2014 | Sun et al. | |

FOREIGN PATENT DOCUMENTS

| | | | |
|---|---|---|---|
| JP | 2011129416 | A | 6/2011 |
| JP | 2015522205 | A | 8/2015 |
| WO | 2013131227 | A1 | 9/2013 |
| WO | 2015062252 | A1 | 5/2015 |
| WO | 2015067677 | A1 | 5/2015 |

* cited by examiner 50a 50b 50c 60a 60b 60c

LIGHTING DEVICE AND LUMINAIRE COMPRISING THE SAME

CROSS-REFERENCE TO PRIOR APPLICATIONS

This application is the U.S. National Phase application under 35 U.S.C. § 371 of International Application No. PCT/EP2017/059403, filed on Apr. 20, 2017 which claims the benefit of PCT/CN 2016/080009, filed Apr. 22, 2016 and European Patent Application No. 16169838.6, filed on May 17, 2016. These applications are hereby incorporated by reference herein.

FIELD OF THE INVENTION

This invention relates to a lighting device comprising a plurality of solid state lighting elements and a lens for shaping the light emitted by the solid state lighting elements. The invention further relates to a luminaire comprising the lighting device.

BACKGROUND OF THE INVENTION

Solid state lighting elements, such as LEDs, are being increasingly employed in lighting devices due to the advantages they offer in terms of energy efficiency and longevity. These advantages have led to a desire to replace traditional bulbs and lamps with lighting devices comprising solid state lighting elements.

However, the colour temperature and 'sparkle' qualities of the lighting effect provided by filament bulbs (e.g. halogen bulbs) remain desirable characteristics of such traditional lighting devices. Hence it remains a challenge to design a lighting device using solid state lighting elements which may approximate or mimic the lighting effect provided by traditional lamps/bulbs. Such a lighting device may often employ a plurality of solid state lighting elements because the light output of a single LED may be less than that produced by, for example, traditional compact fluorescent/incandescent lamps. Furthermore, solid state lighting elements generally approximate point sources such that a plurality of solid state lighting elements may be required in order for the lighting device to illuminate in different directions.

A further benefit to use of a plurality of solid state lighting elements is the possibility to produce a lighting effect which may approximate the colour temperature produced by a traditional lamp, such as a halogen bulb. It may be desirable to configure the solid state lighting elements such that the colour temperature decreases with greater degree of dimming in order to more closely approximate the lighting effect of a traditional lamp/bulb. The colour temperature may, for example, be tuned by mixing the light generated by at least two solid state lighting elements configured to emit white light of different spectral composition relative to each other.

Lighting devices employing solid state lighting elements may for example comprise a lens body surrounding an elongate carrier bearing a plurality of solid state lighting elements. The lens body may, in some respects, replicate the shape and appearance of, for example, a traditional halogen bulb; the elongate carrier mimicking the filament of such a bulb.

The lens body may provide a degree of beam shaping of the light produced by the plurality of solid state lighting elements. However, the lens body may result in different beam shaping effects of light emitted from solid state lighting elements depending on where they are mounted on the elongate carrier which may result in poor merging of the light profiles generated by the lens body corresponding to solid state lighting elements mounted on different regions of the elongate carrier. This effect may result in poor mixing of light emitted by the various solid state lighting elements. This can produce image artifacts, e.g. rings, in the overall image produced by the lens body.

This may be particularly noticeable if the solid state lighting elements are configured to emit light (e.g. white light) of different spectral composition relative to each other due to the different colours of the resulting poorly merged light profiles. Colour mixing of light of different spectral compositions (e.g. high and low colour temperature white light) may be used to approximate the 'warm glow' lighting effect of dimmed halogen/incandescent light sources. Poor colour mixing resulting from poorly merged light profiles may result in less effective mimicking of this lighting effect by a solid state lighting device.

This beam shaping issue is illustrated by the prior-art lighting device 10 shown in FIG. 1. The lighting device 10 comprises a lens body 11 encapsulating a (gas-filled) cavity 12, with an elongate carrier 15 comprising a plurality of solid state lighting elements 16 extending into the said cavity 12. The solid state lighting elements 16 may be positioned along the length of the elongate carrier 15. The inner surface 13 of the lens body 11 may arch over the elongate carrier 15.

The arrows in FIG. 1 schematically represent the path of (selected) light rays from the solid state lighting elements 16*a* and 16*b* mounted at different lengths along the elongate carrier 15. In spite of one of the depicted light rays emitted from solid state lighting element 16*a* being substantially parallel with respect to the depicted light ray emitted from solid state lighting elements 16*b*, the respective rays are incident on differently shaped surface portions of the inner surface 13 (differing in terms of how curved they are relative to each other) which may cause these rays to be refracted by the lens body to different extents. Thus FIG. 1 is illustrative of the different beam shaping effect of the lens body 11 on the light emitted by solid state lighting elements 16 depending on their position on the elongate carrier 15. This effect may result in at least partially separated light profiles generated by the lens body corresponding to the respective solid state lighting elements 16*a* and 16*b* being visible on a surface (not shown) illuminated by the lighting device 10. These profiles may be perceived as distinct bright areas or rings appearing on the surface corresponding to light emitted from respective solid state lighting elements 16 mounted on different positions of the elongate carrier 15.

This effect may be illustrated with reference to FIG. 10 which shows a simulated lighting effect on a surface illuminated by the prior-art lighting device 10 (not shown in FIG. 10). Pane 50*a* shows the lighting effect provided by the solid state lighting elements 16*b* (with solid state lighting elements 16*a* not emitting). Pane 50*b* shows the lighting effect provided by the solid state lighting elements 16*a* (with solid state lighting elements 16*b* not emitting). It may be seen in pane 50*c* wherein both 16*a* and 16*b* are emitting, that the images corresponding to the respective solid state lighting elements are clearly distinguishable (i.e. are poorly mixed); the illumination of the surface being noticeably dominated by the bright ring corresponding to the light emitted by solid state lighting elements 16*a*.

Furthermore, if the solid state lighting elements 16*a* and 16*b* are configured to emit light of different spectral composition relative to each other, the colour-mixing of the light emitted by the respective solid state lighting elements may be poor. This effect may result in the appearance of differently coloured bright areas/rings on a surface illuminated by the lighting device 10.

SUMMARY OF THE INVENTION

The present invention seeks to provide a lighting device comprising a plurality of solid state lighting elements which may uniformly illuminate a surface.

The present invention further seeks to provide a luminaire comprising at least one lighting device.

The invention is defined by the claims.

In accordance with an embodiment, there is provided a lighting device comprising a mounting surface; a lens comprising a lens body having an inner surface encapsulating a cavity and delimiting an entrance to said cavity, said entrance facing the mounting surface, the inner surface comprising a plurality of adjoining surface sections each defining a segment of the cavity, wherein each segment has a narrowing region distal to the entrance delimited by a curved portion of the surface section delimiting said segment; and an elongate carrier extending from the mounting surface into the cavity segments through the cavity entrance and comprising a plurality of solid state lighting elements configured to emit light towards the lens body.

The present invention is based on the realization that the lighting effect of the prior-art lighting device may be improved by employing a lens body with an inner surface comprising a plurality of adjoining surface sections. The adjoining surface sections, which each include a curved portion, may result in light emitted by solid state lighting elements mounted on different positions of the elongate carrier, and which may be incident on different surface sections of the inner surface, being refracted to similar extents relative to each other at the cavity/inner surface interface. Each curved portion of the inner surface may be considered to emulate the refractive properties of the more curved portions of the arched (single-surface-sectioned) inner surface of the lens body of the prior-art lighting device. The inclusion of a curved portion in each of the surface sections of the lens body of the lighting device according to any of the herein embodiments may result in the surface sections possessing similar refractive properties relative to each other. In this way the lens body may provide similar beam shaping of light emitted from solid state lighting elements mounted on different regions (e.g. along the length) of the elongate carrier. Accordingly, the lens body may (more) effectively merge the light profiles generated by the lens body corresponding to solid state lighting elements mounted on different regions of the elongate carrier such that the lighting device may provide a more uniform illumination of a surface (compared to the prior-art lighting device).

Each surface section may extend between a first edge proximal to the entrance and a second edge distal to the entrance, and may have an inflection-free profile in between the first edge and the second edge.

The inflection-free profile may assist in decreasing reflection of light at the inner surface such that more light emitted by the solid state lighting elements passes directly through the lens body, thereby improving the luminous efficiency of the lighting device.

Each segment may further comprise a further region in between the narrowing region and the entrance, the further region delimited by a further portion of the surface section delimiting said segment.

At least some of the further portions may linearly extend in a direction from the entrance to the narrowing portion of the segment comprising the linearly extending further portion.

The linearly extending further portions may provide greater sideways deflection of light than the curved portions; the curved portions providing more upwards deflection of light (away from the mounting surface). Thus a lens body comprising linearly extending portions as well as curved portions may provide effective beam-spreading of the light emitted by the solid state lighting elements. This effective beam-spreading may permit greater overlap (i.e. more effective merging) of the light profiles generated by the lens body corresponding to each of the solid state lighting elements with each other such that a more uniform illumination of a surface lit by the lighting device may be attained.

The cavity may comprise an elongate cross-section parallel to the cavity entrance.

An elongate cross-section parallel to the cavity entrance may assist the lighting device to provide a more widely distributed lighting effect. Such a lighting effect may comprise more widely distributed light profiles generated by the lens body corresponding to the solid state lighting elements. This may permit greater overlap (i.e. more effective merging) of these profiles with each other such that a more uniform illumination of a surface lit by the lighting device may be attained.

The elongate cross-section may comprise rounded end regions interconnected by inwardly curving adjoining regions or planar adjoining regions.

Such a shape of the cross-section parallel to the cavity entrance may result in the lens body being shaped such that the lighting device may provide a widely distributed lighting effect, such as a batwing-type distribution.

The lens body may comprise a dome-shaped outer surface.

A dome-shaped outer surface may assist in providing further beam shaping of light emitted by the plurality of solid state lighting elements.

The outer surface may be a smooth surface or a faceted surface.

A smooth surface may have a higher surface fidelity for conventional manufacturing technologies than that of a faceted surface. However, facets may generate a dispersed light beam with a very small dispersion angle. The dispersed light beams generated by each small facet may overlap to create an additional light mixing effect. A faceted outer surface may also contribute to a 'sparkle' effect to the lighting device.

The plurality of solid state lighting elements may be mounted in spatially separated sets along the length of the elongate carrier.

Each set may comprise one or more solid state lighting element(s), and may emit light towards a segment of the inner surface such that the light emitted by each set may be similarly shaped by the lens body relative to each other. This may assist the lighting device to provide a uniform lighting pattern on a surface illuminated by the lighting device.

At least two of the sets may be adapted to emit light of different spectral composition with respect to each other.

By employing sets which are adapted to emit light of different spectral composition with respect to each other, the lighting device may provide light with a defined spectral composition via colour mixing, e.g. a colour temperature ranging from about 1,500 to about 8,000 K, e.g. from about 2,000 K to about 4,000 K, and/or a coloured output having a spectral composition having a central spectral component ranging from 400 nm to 700 nm for example. These sets may be further configured to be dimmable to different extents relative to each other upon overall dimming of the lighting device. Thus the overall spectral composition (e.g. the colour temperature) may be adjusted (e.g. decreased) as the lighting device is dimmed In this way, the 'warm glow' lighting effect of dimmed halogen/incandescent light sources may be emulated by the lighting device. The lens may assist in providing uniform colour mixing of the light produced by the at least two sets. This uniform colour mixing may result in a lighting pattern on a surface which may be uniform also in terms of the homogeneity of colour (or colour temperature).

At least one set may be mounted on the elongate carrier such that it aligns with a curved portion of one of the surface sections.

Mounting of the at least one set such that it aligns with a curved portion of one of the surface sections may assist in beam shaping of the light emitted by the at least one set such that an overall uniform lighting pattern on a surface illuminated by the lighting device may be achieved.

The elongate carrier may comprise at least two elongate mounting surfaces carrying the solid state lighting elements.

Mounting the solid state lighting elements on at least two elongate mounting surfaces may permit light to be emitted in at least two different directions towards the lens body. This may assist in the lighting device to provide a widely distributed lighting effect.

The elongate carrier may comprise at least one printed circuit board; wherein the solid state lighting elements are surface-mounted on the at least one printed circuit board.

The lighting device may be a capsule light bulb.

The lighting device being a capsule light bulb may assist in the lighting device replacing, for example, halogen capsule light bulbs in lighting fixtures such as spot lamps.

In accordance with another aspect, there is provided a luminaire comprising the lighting device according to any of the herein embodiments.

A luminaire comprising the lighting device may provide a uniform illumination by virtue of the luminaire comprising the lighting device according to any of the herein embodiments or a plurality of such lighting devices.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
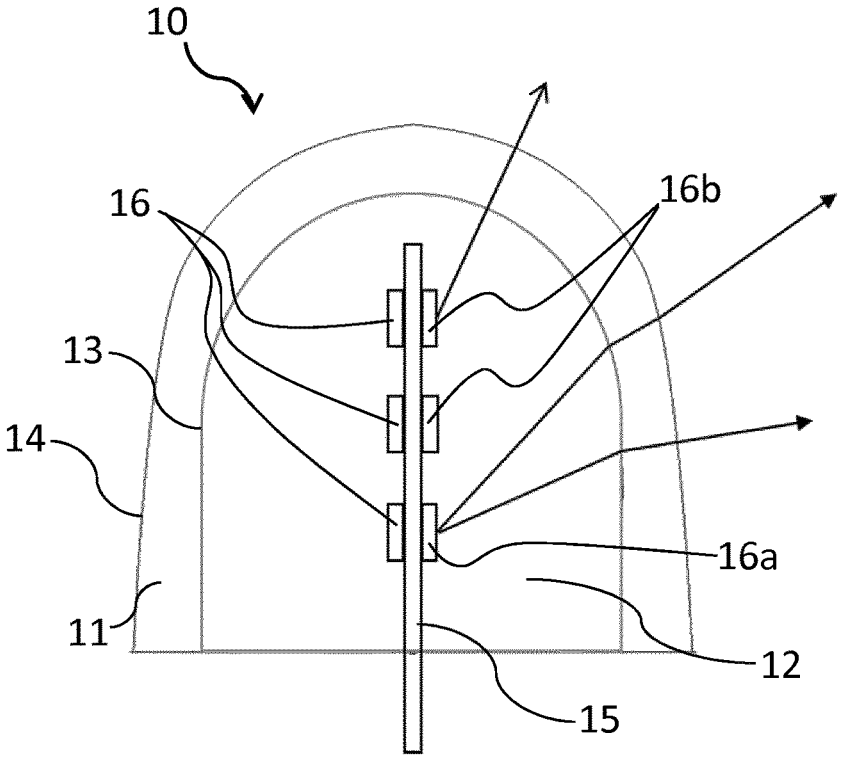
FIG. 1 schematically depicts a cross-section view showing an aspect of a prior-art lighting device.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts, unless otherwise stated.

In the context of the present application, the term 'approximately rectangular' is intended to convey that the elongate carrier may comprise an overall rectangular/square cross-section but the corners of the rectangle may not necessarily be right-angled; they may be, for example, rounded or truncated. Thus the term 'approximately cuboidal' is intended to convey that the elongate carrier may comprise an overall rectangular/square cross-section but the corners of the cross-section may not necessarily be right-angled; they may be, for example, rounded or truncated.

In the context of the present application, the terms 'approximately triangular', 'approximately pentagonal' and 'approximately hexagonal' are intended to convey that the elongate carrier may comprise an overall triangular, pentagonal or hexagonal cross-section but the vertices of the triangle, pentagon or hexagon may be rounded or truncated.

In the context of the present application, the term 'approximately cylindrical' is intended to convey that the elongate carrier may comprise an elliptical cross-section.

In the context of the present application, the term 'peanut-shape' is intended to convey that the shape of the cavity may resemble the shape of an (unpeeled) peanut.

In the context of the present application, the term 'substantially parallel' is intended to include angular orientations of light rays in which the angle between the respective light rays is between 170-190°.

The present invention is based on the realization that a lighting device comprising a lens body with an inner surface comprising a plurality of adjoining surface sections, each surface section including curved portion, may result in a lighting device which may provide a more uniform lighting pattern on a surface illuminated by the lighting device than that provided by the prior-art lighting device 10 (shown in FIG. 1). Each curved portion of the inner surface may be considered a pass-through surface, each of which may emulate the refractive properties of the more curved portions of the arched inner surface of the prior-art lighting device 10. The inclusion of the curved portions of the adjoining surface sections may result in substantially parallel light rays emanating from different regions (e.g. along the length) of the elongate carrier being refracted at the inner surface of the lens body to similar extents. This may be due to the respective light rays being incident on similarly curved surface portions of the inner surface. Accordingly the lens body may effectively merge the light profiles generated by the lens body corresponding to solid state lighting elements mounted on different regions (e.g. along the length) of the elongate carrier such that the lighting device according to any of the herein embodiments may provide a more uniform lighting pattern on a surface than provided by the prior-art lighting device 10.

Figure 2:
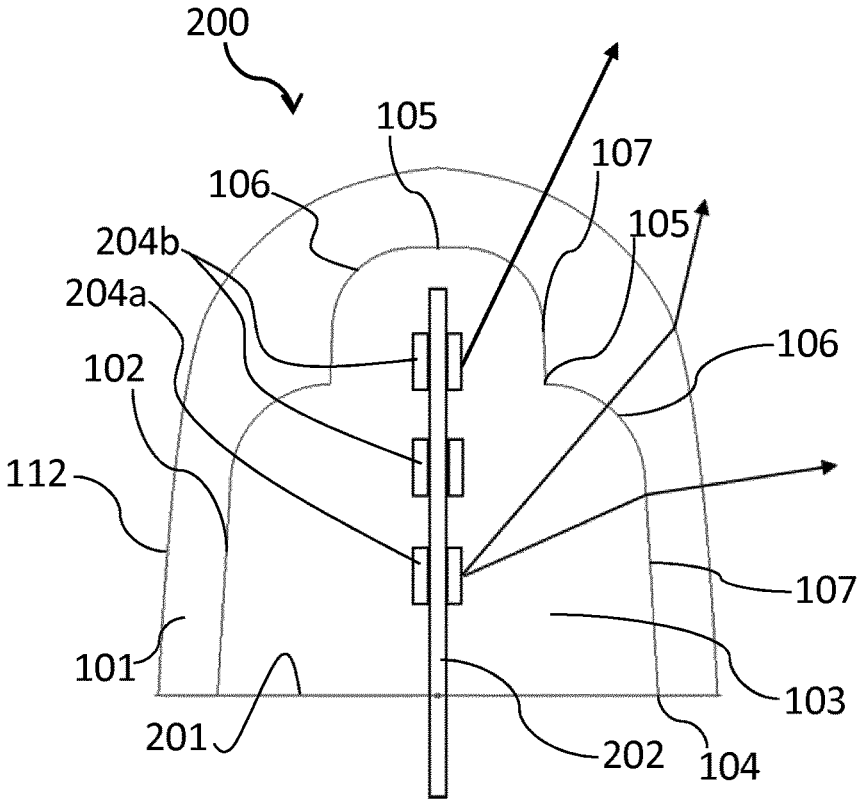
FIG. 2 schematically depicts a cross-section view showing an aspect of a lighting device according to an embodiment.

FIG. 2 schematically depicts a lighting device 200 according to an embodiment. The lens body 101 may be mounted on a mounting surface to 201 with an inner surface 102 of the lens body 101 encapsulating a cavity 103. An entrance to the cavity 103 may face the mounting surface 201, i.e. may be sealed by the mounting surface 201. The inner surface 102 may comprise a plurality of adjoining surface sections which each define a segment of the cavity 103. Each segment may have a narrowing region distal to the entrance of the cavity which is delimited by a curved portion 106. An elongate carrier 202 may extend from the mounting surface 201 into the cavity 103 through the cavity entrance. The elongate carrier 202 may comprise a plurality of solid state lighting elements 203 which may be configured to (or mounted such that) they emit light towards the lens body 101.

It should be understood that the path of the light rays (arrows) shown in FIG. 2 is intended to schematically illustrate that the lens body 101 may refract substantially parallel light rays emanating from different regions of the elongate carrier 202 at the cavity 103/inner surface 102 interface to similar extents relative to each other. Thus FIG. 2 should not be interpreted as providing a geometrically precise representation of the refractive properties of the lens body 101. It should be further noted that whilst FIG. 2 only depicts three light rays which may be used to illustrate the effect of the lens body 101, each of the solid state lighting elements 203 may emit light rays towards the lens body at a range of angles. The intensity of the output of the solid state lighting element 203 may vary as a function of the angle such that the output may be considered a distribution (e.g. a Lambertian distribution) over the range of angles.

It may be seen from FIG. 2 that the light ray emanating from 204*b* may pass through the lens body 101 without undergoing substantial refraction by the lens body 101. One of the light rays emanating from 204*a*, which is substantially parallel to that emanating from 204*b* (but emitted from a different region of the elongate carrier), may pass into the lens body 101 via a curved portion 106 of the inner surface 102 without undergoing substantial refraction at the cavity 103/inner surface 102 interface. Thus FIG. 2 is illustrative the lens body 101 causing similar refraction of the respective rays emanating from different regions on (e.g. along the length of) the elongate carrier 202. This may result in effective merging of the images corresponding to the solid state lighting elements 204*a* and 204*b* in an illumination pattern on a surface lit by the lighting device 200.

In an embodiment, each segment may further comprise a further region in between the narrowing region and the entrance. This further region may be delimited by a further portion 107 of the surface sections. In an embodiment, at least some of the further portions 107 may linearly extend in a direction from the entrance to the narrowing portion of the segment. In this way, the surface sections 102 may comprise both linearly extending portions 107 and curved portions 106 such that segments provide the beam shaping/refracting properties of both linear and curved portions 106. Thus the cavity 103 may be considered to comprise a stack of segments which each provide similar beam shaping properties with respect to each other. In this way, the light emitted by solid state lighting elements 203 may be similarly refracted by the lens body 101 regardless of where along the length of elongate carrier 202 the solid state lighting elements 203 may be mounted. Thus the light emitted from the different regions of the elongate carrier may be merged by the lens body 101 such that the lighting device 200 provides an overall uniform lighting pattern on a surface illuminated by the lighting device 200.

The solid state lighting elements 203 may, in an embodiment, be mounted in spatially separated sets 204 along the length of the elongate carrier 202. Each set 204 may comprise one or more solid state lighting element(s) 203. The solid state lighting elements 203 preferably may be LEDs. In an embodiment, at least two of the sets 204 may be adapted to emit light of different spectral composition with respect to each other. For example, the at least two sets may be configured to produce white light but with different colour temperature with respect to each other, e.g. a colour temperature ranging from about 1,500 to about 8,000 K, e.g. from about 2,000 K to about 4,000 K, and/or a coloured output having a spectral composition having a central spectral component ranging from 400 nm to 700 nm for example. The sets 204/solid state lighting elements 203 may be dimmable. In an example, these sets 204 may be further configured to be dimmable to different extents relative to each other upon overall dimming of the lighting device 200. Thus the overall spectral composition (e.g. the colour temperature) may be adjusted (e.g. decreased) as the lighting device is dimmed. In this way, the 'warm glow' lighting effect of dimmed halogen/incandescent light sources may be emulated by the lighting device 200.

In such example embodiments, the lens body 101 may provide similar degrees of beam shaping of the light emitted by the solid state lighting elements 203 or sets 204, regardless of their position along the length of the elongate carrier 202 such that the lens body 101 may assist to homogenize the overall spectral composition produced by the lighting device 200. This may, for example, result in a lighting effect on a surface illuminated by the lighting device 200 comprising a substantially uniform lighting pattern with an evenly colour mixed spectral composition.

In an embodiment, the elongate carrier 202 may comprise at least two elongate mounting surfaces carrying the solid state lighting elements 203. The two elongate mounting surfaces may be, for example, opposing surfaces of the elongate carrier 202. In non-limiting examples, the elongate carrier 202 may comprise a polygonal cross-section such that the elongate carrier 202 may comprise a plurality of elongate mounting surfaces corresponding to the sides of the polygonal cross-section. In this way, light may be emitted towards the lens body 101 from the elongate carrier 202 in a plurality of directions. In a non-limiting example, the cross-section of the elongate carrier 202 may comprise a rectangular, or approximately rectangular, cross-section and the elongate mounting surfaces may be opposite sides of a cuboidal, or approximately cuboidal, elongate carrier 202. In such an example, the solid state lighting elements 203 may, for example, emit light in opposite directions towards the lens body 101. Alternatively, the solid state lighting elements 203 may be mounted on three or four elongate mounting surfaces (corresponding to the sides of the rectangular or approximately rectangular cross-section) such the light may be emitted from (the elongate mounting surfaces) of the elongate carrier 202 in up to four different directions.

In alternative non-limiting examples, the elongate carrier 202 may a comprise triangular, pentagonal, hexagonal, or approximately triangular, approximately pentagonal, approximately hexagonal etc., cross-section such that light may be emitted towards the lens body 101 in a plurality of directions which may correspond to two or more sides of the polygonal cross-section. Alternatively, the elongate carrier 202 may comprise a cylindrical shape, or an approximately cylindrical shape, and the solid state lighting elements 203 may be mounted along the length and around the circumference of elongate carrier 202. Other shapes for the elongate carrier 202 will be immediately apparent to the skilled person and will not be elaborated upon further for the sake of brevity only.

In an embodiment, the elongate carrier 202 may comprise a printed circuit board and the solid state lighting elements 203 or sets 204 may be surface-mounted on the printed circuit board. The solid state lighting elements 203 may, in a non-limiting example, be mounted on both sides of a single printed circuit board such that light may be emitted from both sides of the printed circuit board. In such an example, the two sides of the printed circuit board may correspond to two elongate mounting surfaces of the elongate carrier 202.

In alternative non-limiting examples, the elongate carrier 202 may comprise a plurality of printed circuit boards and the solid state lighting elements 203 may be mounted on one or both sides of the printed circuit boards such that they emit light towards the lens body 101.

Solid state lighting elements 203 may be fixed to on the printed circuit board(s) by any suitable means, such as by use of an adhesive or an adhesive strip. The adhesive/adhesive strip may, for example, be thermally conductive such that heat generated by the solid state lighting elements 203 may be more readily dissipated. The means of mounting solid state lighting elements 203 are well-known per se and will not be further elaborated on herein the sake of brevity only.

In an embodiment, the cross-section of the cavity 103 may be elongated. In such a design, the elongate carrier 202 may, for example, be cuboidal, or approximately cuboidal, and the solid state lighting elements 203 may be on opposite elongate mounting surfaces of elongate carrier 202. In this non-limiting example, the combination of the elongated cross-section of the lens body 101 and elongate carrier 202 may permit the lighting device 200 to provide a widely distributed lighting effect by light being emitted in both lengthways directions of the elongated cavity 103. This more widely distributed lighting effect may comprise more widely distributed light profiles generated by the lens body 101 corresponding to each of the solid state lighting elements 203. Thus greater overlap of these light profiles with each other (i.e. more effective merging of these light profiles) may be achieved resulting in a more uniform illumination of a surface lit by the lighting device 200.

The mounting surface 201 may comprise any suitable material such as a metal or metal alloy, polymer, composite or a mixture thereof. In a non-limiting example, the mounting surface 201 may be a reflective surface such that residual light which may be reflected from the lens body 101 may be redirected from the mounting surface 201 back towards the lens body 101. The reflective surface may be specularly or diffusely reflective and may, for example, comprise a white painted surface, or a mirrored surface. In a non-limiting example, the reflective surface may be a faceted reflective surface comprising a plurality of reflective facets which may reflect light in different directions relative to each other so as to provide diffuse reflectance. Diffuse reflectance may assist with providing a uniform lighting pattern on a surface illuminated by the lighting device 200.

The lens body 101 may comprise any suitable material such as a glass, polymer or polymer blend. In non-limiting examples, the lens body 101 may comprise a suitable optical polymer such as polycarbonate, poly(methyl methacrylate), polyethylene terephthalate, polyethylene naphthalate, cyclic olefin copolymer, or a blend thereof. The lens body 101 may be fabricated using any suitable technique, such as by injection molding of the aforementioned optical polymer/polymer blend. Such techniques for lens manufacture are well-known per se and will not be further discussed herein for the sake of brevity only.

The lens body 101 may be fixed to the mounting surface 201 by any suitable means, such as by use of an adhesive or adhesive strip(s).

The cavity 103 of the lighting device 200, may be a gas-filled cavity such as an air-filled cavity. In alternative non-limiting examples, the cavity 103 may be filled by other gases such as nitrogen or a noble gas, which may assist to increase the longevity of the lighting device 200 by assisting to prevent (or retard) oxidative degradation of the components of the lighting device which may reduce its lifespan.

Figure 3A:
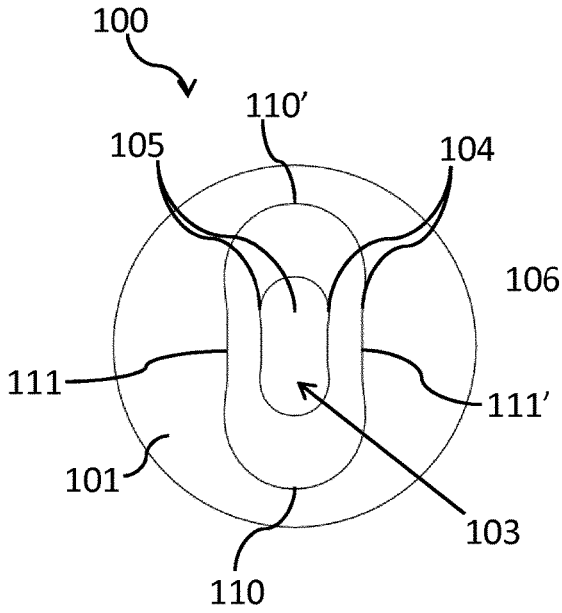
FIG. 3*a* schematically depicts a cross-section view of a lens body of a lighting device according to an embodiment.

FIG. 3*a* depicts a cross-section of a lens 100 according to an embodiment. The lens 100 may comprise a lens body 101 encapsulating the cavity 103. FIG. 3*a* further depicts the starting points 104 at which the surface sections begin and termination points 105 at which the surface section terminates. The cross-section of the cavity 103 may be elongated and may comprise rounded end regions 110, 110' interconnected by adjoining regions 111, 111'. Such adjoining regions 111, 111' may be planar or inwardly curving. Such a cavity 103 may be considered to comprise a peanut shape. Peanut-shaped cavities 103 may assist the lens 100 to provide a widely distributed lighting effect, such as a batwing-type lighting effect.

Figure 3B:
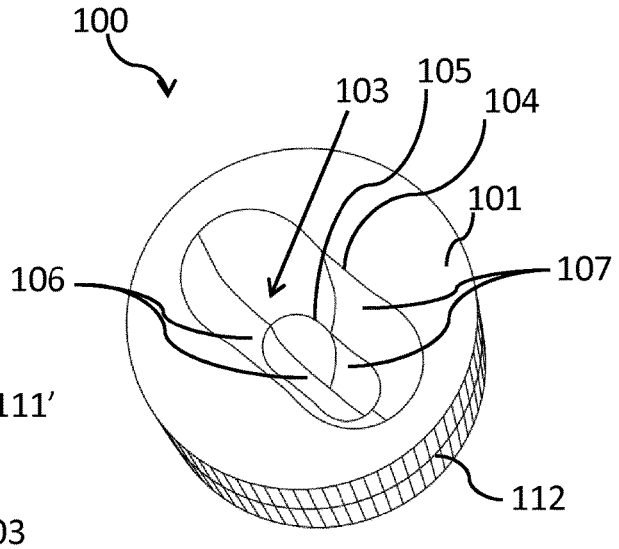
FIG. 3*b* schematically depicts a perspective view of the lens body shown in FIG. 3*a*.

FIG. 3*b* depicts a perspective view of the lens 100 shown in FIG. 3*a*. In the non-limiting example shown in FIG. 3*b*, the cavity 103 may comprise two segments: a wider segment defined by a surface section beginning at a point (or contour) 104 and terminating at point (or contour) 105, and a narrower segment beginning at point 105. It should be understood that the adjoining nature of the surface sections may mean that the terminating 105 of one surface section may be the same as the beginning point 104 of an adjoining surface section. The two cavity segments shown in FIG. 3*b* may be defined by surface sections comprising curved portions 106 and further portions 107 (e.g. linearly extending further portions) of the adjoining surface sections as previously described.

The outer surface 112 of the lens body 101 is also shown in FIG. 3*b*. The outer surface 112 may be shaped to provide additional beam shaping for the lighting device 200. In embodiments, the outer surface 112 may be a smooth or faceted surface. A smooth outer surface 112 may have a higher surface fidelity for conventional manufacturing technologies than that of a faceted outer surface 112. On the other hand, a smooth outer surface 112 may refract different wavelengths of light to different extents such that the color homogeneity of a lighting pattern on a surface (not shown in FIG. 3*b*) illuminated by a lighting device 200 may be improved by employing a faceted outer surface 112. The facets may generate a dispersed light beam with a very small dispersion angle. The dispersed light beams generated by each small facet may overlap to create an additional light mixing effect such that the light from each of the facets may combine to provide a relatively homogeneously coloured pattern on a surface illuminated by the lighting device 200. Facets may also contribute a 'sparkle' effect to the lighting device 200.

Figure 4A:
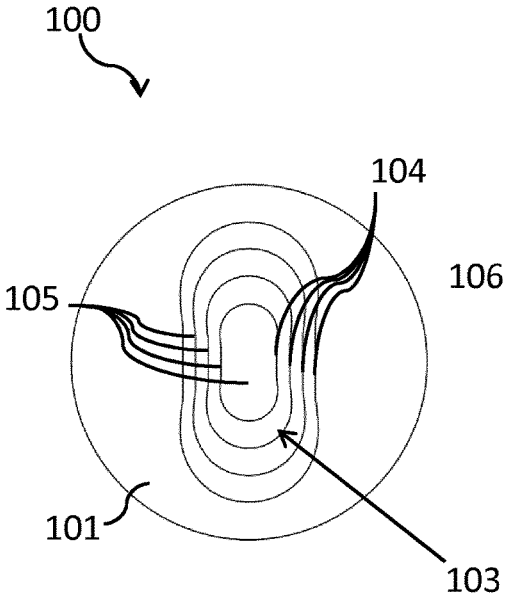
FIG. 4*a* schematically depicts a cross-section view of a lens body of a lighting device according to another embodiment.
Figure 4B:
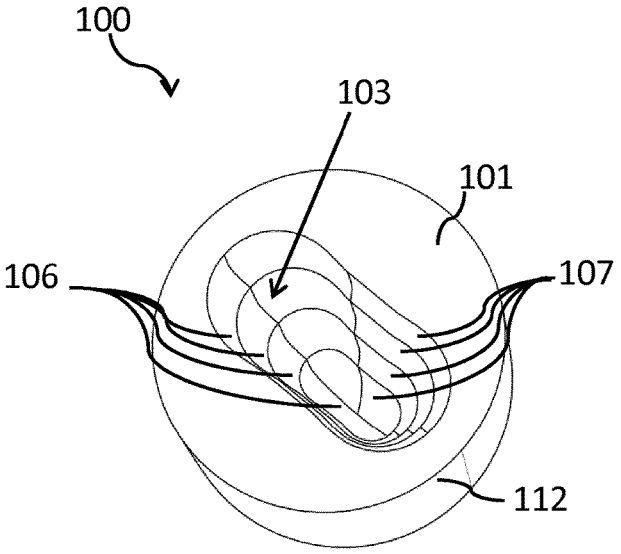
FIG. 4*b* schematically depicts a perspective view of the lens body shown in FIG. 4*a*.

FIG. 4*a* depicts a cross-section of a lens 100 according to another embodiment. The lens 100 may comprise a cavity 103 comprising four segments defined by adjoining surface sections beginning at points 104 and terminating at points 105. The lens 100 is further depicted in perspective view in FIG. 4*b*, such that it may be seen that the four segments may be defined by adjoining surface sections which may comprise curved portions 106 and further portions 107 (e.g. linearly extending further portions) of the adjoining surface sections as previously described. The outer surface 112 in FIG. 4*b* may, for example, be a smooth surface. It should be understood that selection of the number of cavity segments and the nature of the outer surface 112 (smooth or faceted) may be made independently of each other.

Figure 5A:
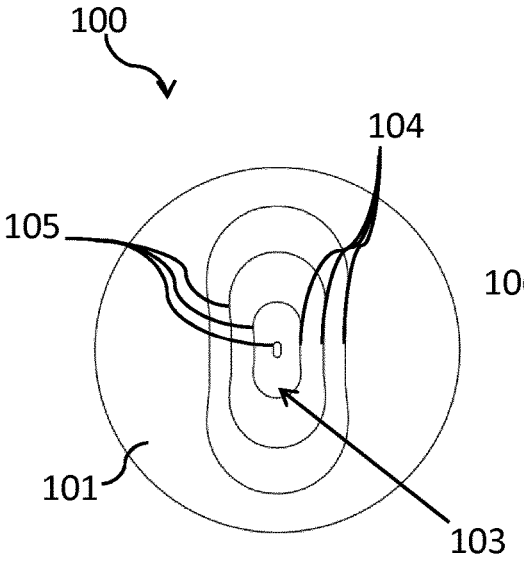
FIG. 5*a* schematically depicts a cross-section view of a lens body of a lighting device according to a further embodiment.
Figure 5B:
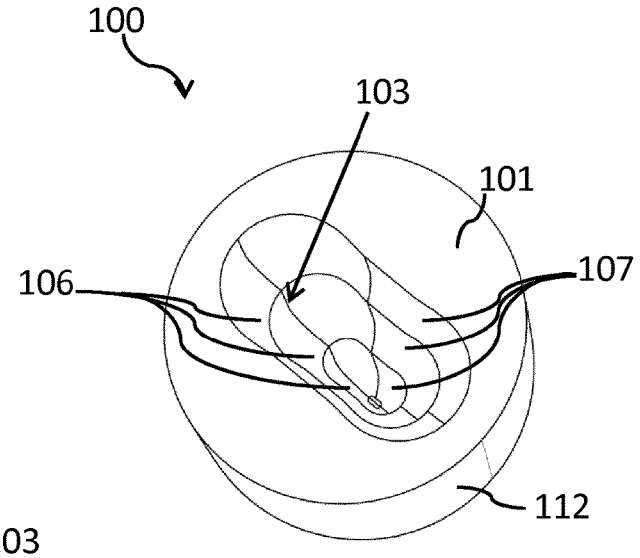
FIG. 5*b* schematically depicts a perspective view of the lens body shown in FIG. 5*a*.

FIG. 5*a* depicts a cross-section of a lens 100 according to a further embodiment. The curved portions 106 and further portions 107 (e.g. linearly extending further portions) of the adjoining surface sections of the lens body 101 of the embodiment depicted in FIG. 5*a* are shown in the perspective view of the lens 100 depicted in FIG. 5*b*. The lens 100 as shown in FIG. 5*a* may also comprise four segments (similarly to the lens 100 as shown in FIG. 4*a/b*). However, the dimensions of the segments of the lens 100 as shown in FIG. 5*a/b* become smaller away from the cavity entrance in a manner which is different from the lens 100 shown in FIG. 4*a/b* in which the segments decrease in size by regular, or fairly regular, increments from segment to segment. In the case of the lens 100 shown in FIG. 5*a/b*, the segment furthest away from the cavity entrance has significantly smaller dimensions than may be extrapolated from the decreasing dimensions of the other (three) segments away from the cavity entrance. Thus it should be understood that dimensions of the segments may not necessarily become incrementally smaller (i.e. in a regular manner), either in terms of length, width or depth, further into the cavity 103 from the cavity entrance.

The extent to which the segments may become narrower with respect to each other may, for example, be partly determined by the position of the solid state lighting elements 203 or sets 204 on the elongate carrier 202. For example, a set 204 of solid state lighting element(s) 203 which extends further along an elongate surface of the elongate carrier 202 may be positioned at least partially within a deeper segment of the cavity 103. Alternatively a deeper segment may at least partially accommodate two spatially separated sets 204. Alternatively or additionally, a shorter set 204 which may extend less far along an elongate surface of elongate carrier 202 may be at least partially accommodated within a shallower segment of the cavity 103.

It should be understood that the number of segments is not especially limited. A lens 100 may, for example, comprise a number of segments in a range between 2 and 10, such as 2, 3, 4 or 5 segments. Employing a lens body 101 comprising adjoining surface sections which may define more segments of the cavity 103, may assist in providing a more uniform lighting pattern on a surface illuminated by the lighting device 200, particularly when the lighting device 200 may comprise more, or more spatially separated, solid state lighting elements 203 or sets 204 mounted along the length of the elongate carrier 202. The skilled person will recognize, however, that the manufacturing accuracy associated with producing a lens 100 may be decreased with increasing numbers of surface sections (segments). Thus there may be a trade-off between enhancing the uniformity of the lighting effect and improving the manufacturing accuracy (decreasing the cost) associated with producing the lens 100 or lighting device 200.

It should be understood that whilst the lens 100 as shown in FIGS. 3-5 may comprise an overall circular cross-section, this is not intended to be limiting such that other overall shapes of cross-section of the lens 100 may also be envisaged. For example, the lens 100 may comprise an overall elliptical cross-section.

Figure 6A:
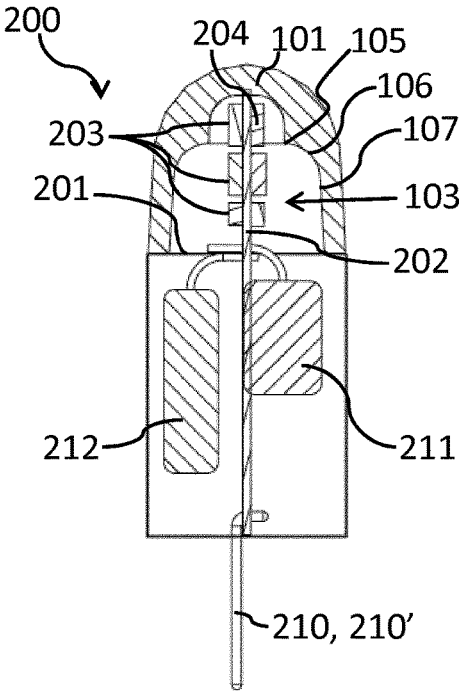
FIG. 6*a* schematically depicts a cross-section view of a lighting device according to an embodiment.

FIG. 6*a* shows a cross-section of a lighting device 100 comprising a lens body 101 mounted on a mounting surface 201; the inner surface 102 of the lens body 101 delimiting a cavity 103. An elongate carrier 202 comprising solid state lighting elements 203 may extend into the cavity 103 from the mounting surface 201. Adjoining surface sections of the inner surface 102 of the lens body 101 may comprise curved portions 106 and further (e.g. linear) portions 107. A non-rounded edge is shown in FIG. 6*a* at point 105 at which the adjoining surface sections meet. Electrical power may be supplied to the lighting device 200 via pins 210 and 210'. The power supplied to the solid state lighting elements 203 or sets 204 may be by regulated by driver components 211 and 212. The driver components 211 and 212 may, for example, each comprise a capacitor. The components and circuitry for driving solid state lighting elements 203 are well-known per se and will not be further described herein for the sake of brevity only.

The solid state lighting elements 203 may, in the non-limiting example shown in FIG. 6*a*, be subdivided into three sets 204 along the length of the elongate carrier 202. Each set 204 may comprise one or more solid state lighting element(s) 203. In the example shown in FIG. 6*a*, the adjoining surface sections of the lens body 101 may define two segments. Two of the sets 204 closest to the mounting surface 201 may be contained within one of the segments, and the remaining set 204 may be at least partially contained within the other segment. It should be noted that the number of sets 204 is not especially limited and may range from 2 to 10, for example, 2, 3, 4, or 5 sets 204 may be employed.

Figure 6B:
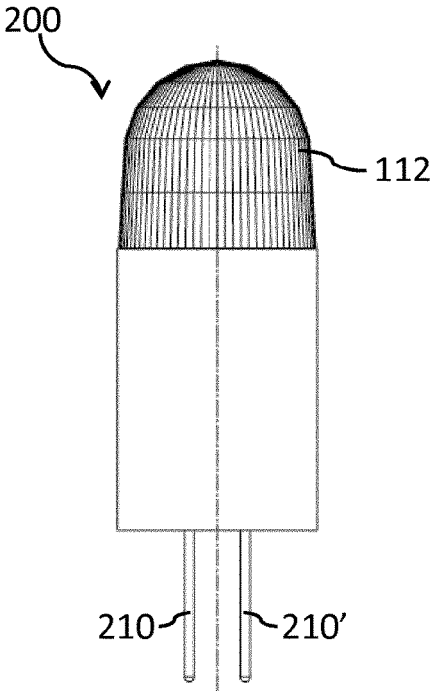
FIG. 6*b* schematically depicts a side-on view of the lighting device shown in FIG. 6*a*.

FIG. 6*b* shows a side-on view of the lighting device 200 shown in FIG. 6*a*. The outer surface 112 of the lens body 101 is, in this non-limiting example, a faceted surface.

Figure 7A:
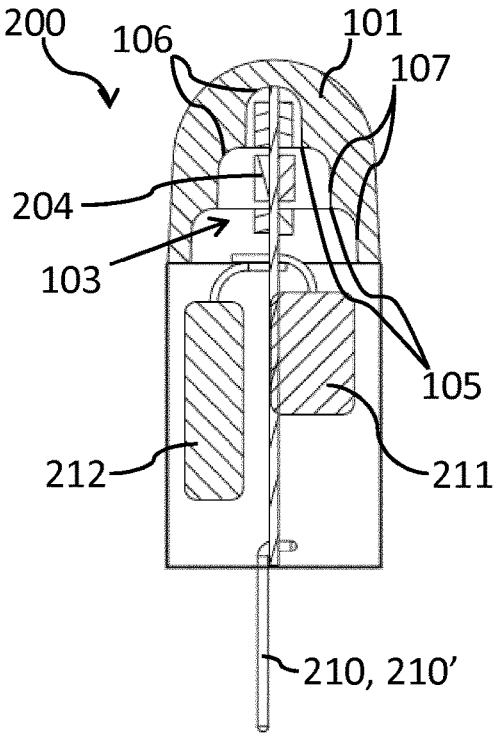
FIG. 7*a* schematically depicts a cross-section view of a lighting device according to another embodiment.

FIG. 7*a* shows a cross-section of a lighting device 100 which differs with respect to the lighting device 200 shown in FIG. 6*a/b* in that the lens body 101 comprises adjoining surface sections which define three segments of the cavity 103. Non-rounded edges are shown in FIG. 7*a* at points 105 at which the adjoining surface sections meet. It should be understood that such non-rounded edges as shown in FIGS. 6*a* and 7*a* should not be regarded as being limiting and that rounded edges are also conceivable. In this regard, the cross-section of the lighting device 200 shown in FIG. 8 may be considered to be similar to that shown in FIG. 7, aside from comprising rounded edges at points 105 at which the adjoining surface sections meet. Rounded edges at points 105 may, for example, decrease reflection of light at the inner surface 102 such that more light may pass through the lens body 101.

Figure 7B:
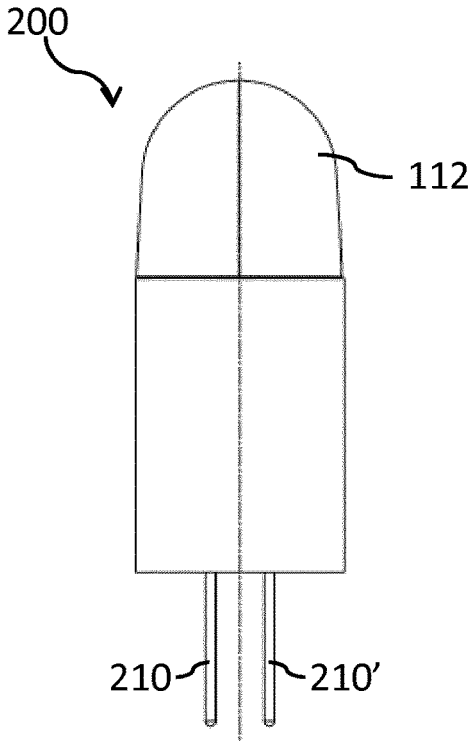
FIG. 7*b* schematically depicts a side-on view of the lighting device shown in FIG. 7*a*.

FIG. 7*b* shows a side-on view of the lighting device 200 shown in FIG. 7*a*. The outer surface 112 of the lens body 101 is, in this non-limiting example, a smooth surface.

Figure 8:
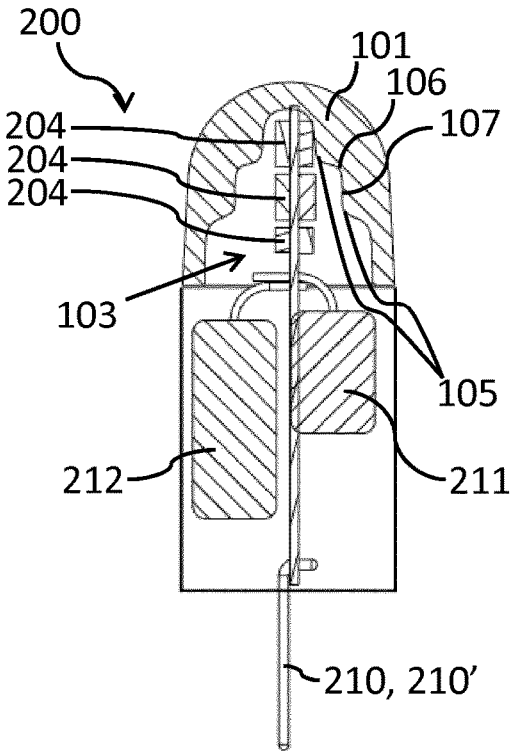
FIG. 8 schematically depicts a cross-section view of a lighting device according to yet another embodiment.
Figure 9:
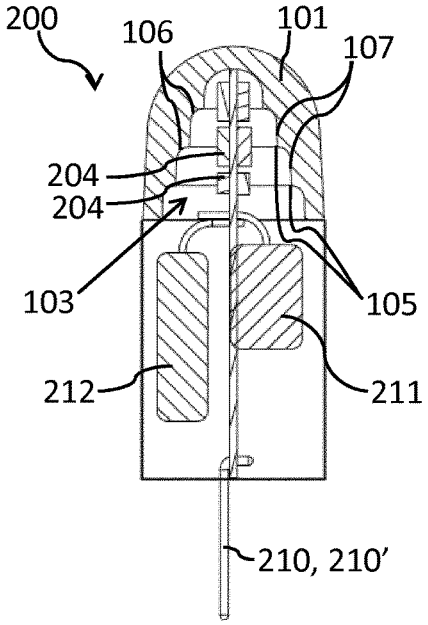
FIG. 9 schematically depicts a cross-section view of a lighting device according to a further embodiment.

FIG. 9 shows a cross-section of a lighting device 100 which differs with respect to the lighting devices 100 shown in FIGS. 6-8 in that the lens body 101 may comprise adjoining surface sections which define four segments of the cavity 103. Non-rounded edges are shown in FIG. 9 at points 105 at which the adjoining surface sections meet, although rounded edges may also be employed as previously described.

Figure 10:
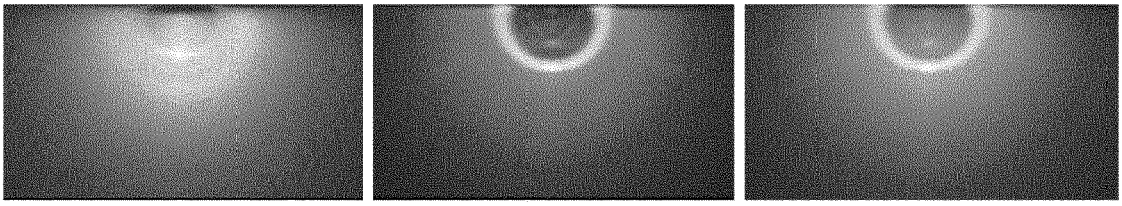
FIG. 10 schematically depicts a simulation of the lighting pattern on a surface illuminated by the prior-art lighting device schematically depicted in FIG. 1.
Figure 11:
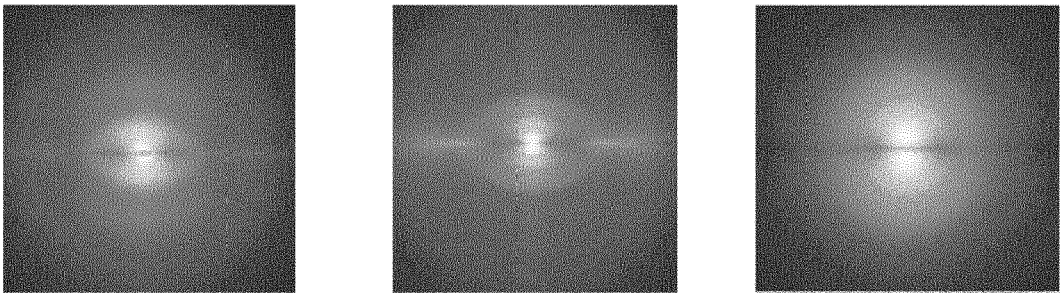
FIG. 11 schematically depicts a simulation of the lighting pattern on a surface illuminated with a lighting device according to an embodiment.

FIG. 11 shows a simulated lighting pattern on a surface illuminated by a lighting device 200 (shown in FIG. 2). Pane 60*a* shows the lighting pattern provided solely by set 204*b* (set 204*a* is not emitting). Pane 60*b* shows the lighting pattern provided solely by set 204*a* (set 204*b* are not emitting). The overall lighting pattern when sets 204*a* and 204*b* are both emitting is shown in pane 60*c*: the lighting effect is substantially uniform due to effective mixing of the light emitted from the respective sets 204 of solid state lighting elements 203. The lighting pattern shown in FIG. 11 may be contrasted with the non-uniform lighting pattern shown in FIG. 10 provided by the prior-art lighting device 10 in which the light emitted from the respective sets of solid state lighting elements 16 appears in separate bright areas/rings on the surface illuminated by the prior-art lighting device 10.

The uniform lighting pattern shown in FIG. 11 may, in embodiments wherein different colour light emitting solid state lighting elements 203 or sets 204 are employed, result in effective mixing of the different coloured light such that an overall evenly-mixed spectral composition of light produced by the lighting device 200 may be attained. In a non-limiting example, the sets 204*a* and 204*b* (shown in FIG. 2) may emit white light with different colour temperatures with respect to each other. In such an example, 204*a* may emit white light with a lower colour temperature such as 2200 K and 204*b* may emit white light with a higher colour temperature such as 3000 K. Different wavelengths of light are refracted to different extents by the lens body 101 such that positioning higher colour temperature light emitting sets closer to the narrowest segment of the lens body 101 (i.e. furthest from the cavity entrance) and lower colour temperature light emitting sets closer to the cavity entrance may, for example, assist to provide a lighting effect with the colour appearing slightly more orange outwards from the centre of the bright pattern on the surface illuminated by the lighting device 200.

Numerous alternative combinations of different colour-emitting sets 204 may be contemplated by the skilled person according to the desired colour temperature of lighting to be provided by the lighting device 200. Such an overall spectral composition may be selected, for example, to approximate the spectral composition emitted by a traditional filament lamp, or a halogen lamp. These sets may be further configured to be dimmable to different extents relative to each other upon overall dimming of the lighting device 200, as previously described. Thus the warm glow lighting effect produced by dimmed halogen/incandescent light sources may be closely emulated by the lighting device 200, which further offers the benefits of energy efficiency and longevity associated with solid state lighting.

According to an aspect, there is provided a luminaire comprising the lighting device 200 according to any of the herein embodiments. Such a luminaire may, in non-limiting examples, comprise a plurality of lighting devices 200 and may be used to provide an overall lighting effect by merging of the light emitted by each of the lighting devices 200. For example, the lighting effect provided by the lighting devices 200 may overlap with each other which may assist in improving the uniformity of the overall lighting effect, which may include even colour-mixing as previously described, provided by the luminaire Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

a mounting surface;

a lens comprising a lens body having an inner surface encapsulating a cavity and delimiting an entrance to said cavity, said entrance facing the mounting surface, the inner surface comprising a plurality of adjoining surface sections each defining a segment of the cavity, wherein each segment has a narrowing region distal to the entrance delimited by a curved portion of the surface section delimiting said segment; and an elongate carrier extending from the mounting surface into the cavity segments through the cavity entrance and comprising a plurality of solid state lighting elements configured to emit light towards the lens body;

wherein the cavity comprises an elongate cross-section parallel to the cavity entrance.

2. The lighting device of claim 1, wherein each surface section extends between a first edge proximal to the entrance and a second edge distal to the entrance, and has an inflection-free profile in between the first edge and the second edge.

3. The lighting device of claim 1, wherein each segment further comprises a further region in between the narrowing region and the entrance, the further region delimited by a further portion of the surface section delimiting said segment.

4. The lighting device of claim 3, wherein at least some of the further portions linearly extend in a direction from the entrance to the narrowing portion of the segment comprising the linearly extending further portion.

5. The lighting device of claim 1, wherein the elongate cross-section comprises rounded end regions interconnected by inwardly curving adjoining regions or planar adjoining.

6. The lighting device of claim 1, wherein the lens body comprises a dome-shaped outer surface.

7. The lighting device of claim 6, wherein the outer surface is a smooth surface or a faceted surface.

8. The lighting device of claim 1, wherein the plurality of solid state lighting elements are mounted in spatially separated sets along the length of the elongate carrier.

9. The lighting device of claim 8, wherein at least two of the sets are adapted to emit light of different spectral composition with respect to each other.

10. The lighting device of claim 8, wherein at least one set is mounted on the elongate carrier such that it aligns with a curved portion of one of the surface sections.

11. The lighting device of claim 1, wherein the elongate carrier comprises at least two elongate mounting surfaces carrying the solid state lighting elements.

12. The lighting device of claim 1, wherein the elongate carrier comprises at least one printed circuit board; wherein the solid state lighting elements are surface-mounted on the at least one printed circuit board.

13. The lighting device of claim 1, wherein the lighting device is a capsule light bulb.

14. A luminaire comprising the lighting device according to claim 1.

* * * * *